US006749482B1

(12) United States Patent
Hollis et al.

(10) Patent No.: US 6,749,482 B1
(45) Date of Patent: Jun. 15, 2004

(54) MULTI-CONFIGURABLE TOY VEHICLE

(75) Inventors: John Rey Hollis, Topanga, CA (US); John Lawren Cook, Redondo Beach, CA (US); Christine Ann Hollis, Topanga, CA (US)

(73) Assignee: Awesome Toys, LLC., Chicago, IL (US)

( * ) Notice: Subject to any disclaimer, the term of this patent is extended or adjusted under 35 U.S.C. 154(b) by 0 days.

(21) Appl. No.: 10/663,254

(22) Filed: Sep. 16, 2003

(51) Int. Cl.[7] ..... A63H 17/267
(52) U.S. Cl. ..... 446/466; 446/470
(58) Field of Search ..... 446/448, 465, 446/466, 469, 470, 431

(56) References Cited

U.S. PATENT DOCUMENTS 3,078,619 A * 2/1963 Brown ..... 446/237
4,477,999 A * 10/1984 Harigai et al. ..... 446/470
4,850,929 A * 7/1989 Genevey ..... 446/466
5,762,533 A * 6/1998 Tilbor et al. ..... 446/466
6,589,098 B2 * 7/2003 Lee et al. ..... 446/465
2001/0004578 A1 * 6/2001 Jaffe ..... 446/456

* cited by examiner

*Primary Examiner*—Jacob K. Ackun, Jr.
(74) *Attorney, Agent, or Firm*—Factor & Lake, Ltd.

(57) ABSTRACT

A multi-configurable toy vehicle having at least two rotatable segments. Each rotatable segment includes a first side having a first design and a second side having a second design. Additionally, each rotatable segment is independently rotatable with respect to each other from a first side orientation to a second side orientation. A movement means, such as pivotal wheels, enables the multi-configurable toy vehicle to move on a surface. The movement means is associated with at least two of the rotatable segments to facilitate operation of the multi-configurable toy vehicle when any of the rotatable segments are in either of the first or second side orientations.

22 Claims, 6 Drawing Sheets

MULTI-CONFIGURABLE TOY VEHICLE

BACKGROUND OF THE INVENTION

1. Field of the Invention

The present invention is directed generally to a toy vehicle, and more specifically to a multi-configurable toy vehicle which is movable on a surface.

2. Background Art

Toy vehicles have been a childhood favorite for many, many years. These toy vehicles often range in size from miniature cars to larger size trucks resembling a fire truck, gasoline truck, or other vehicle of interest. The child typically races these cars against other toy vehicles or rolls the toy vehicle over a surface for entertainment. These toy vehicles are limited, however, in that they typically only have one configuration. Thus, a child often plays with the toy vehicle for a period of time, becomes disinterested, and quickly desires another toy for entertainment. This can add up to significant cost and frustration for a caretaker of the child.

Similarly, action figures have likewise been a childhood favorite for years. These action figures can vary in size, and may even resemble known fictional or non-fictional characters. Some such action figures have moving parts such as rotatable arms or movable neck and legs. As with the toy vehicles discussed previously, children generally become quickly disinterested in these action figures because they only have a single configuration.

Other action figures exist which have multiple components which can be manipulated into various orientations, so as to result in a single toy having different configurable playable images. Although these action figures have multiple orientations, a child also becomes disinterested with these toys because the action figures are limited in that the child can only simulate movement of the toy. Therefore, again, a child often plays with the toy for a period of time, becomes quickly disinterested, and desires another toy for entertainment. This also can add up to significant cost and frustration for the caretaker of the child.

SUMMARY OF THE INVENTION

The present invention relates to a multi-configurable toy vehicle having at least two rotatable segments and a movement means for enabling movement of the multi-configurable toy vehicle on a surface. Each of the rotatable segments includes a first side having a first design and a second side having a second design. Each rotatable segment is independently rotatable with respect to another rotatable segment from a first side orientation to a second side orientation. Preferably, the rotatable segments are disposed along a common axis which is parallel to a bottom surface of the toy vehicle.

The first side and the second side of the rotatable segments are rotatable into a plurality of different combinations associated with each respective first side orientation and second side orientation. In one preferred embodiment, the toy vehicle has three rotatable segments which are capable of being manipulated into eight different configurations by selectively rotating the rotatable segments. It is contemplated that a greater number of rotatable segments may be utilized to result in any number of combinations. In another embodiment, the number of rotatable segments is at least three and at least one of the at least three rotatable segments has more than two sides.

In a preferred embodiment, the toy vehicle is manipulated into different configurations by selectively rotating the first design or the second design of one rotatable segment adjacent the first design or second design of an adjacently positioned rotatable segment so as to form a predetermined figure design. The figure design may optionally comprise a truck, tank, fictional character, non-fictional character, or any other design.

In a preferred embodiment, the movement means enables the multi-configurable toy vehicle to move on a surface. The movement means is associated with at least two of the rotatable segments to facilitate operation of the multi-configurable toy vehicle when any of the rotatable segments are in either of the first or second side orientations. Specifically, the movement means comprises at least one rotatable member associated with a first rotatable segment and at least two rotatable members associated with a second rotatable segment. By having at least one rotatable member on one rotatable segment and at least two rotatable members on another rotatable segment, the toy vehicle is easily movable about a surface. The rotatable members may comprise wheels, treads, or any other conventional structure which enables movement of the toy vehicle.

To allow for a greater number of different configurations, the movement means may include a pivotal manipulation means for pivotally manipulating at least one of the rotatable members from a first location, wherein at least a portion of the rotatable member extends below a bottom surface of the associated rotatable segment, to a second location, wherein at least a portion of the rotatable member extends above a top surface of the associated rotatable segment. It is contemplated that the rotatable segments need not rotate. Alternatively, the toy vehicle may include at least one segment, wherein the pivotal manipulation means pivots from a first location to a second location to provide for different configurations of the toy vehicle.

In yet another preferred embodiment, the toy vehicle includes releasable securement means to secure the rotatable members in a selected location. Each rotatable member preferably has an axle associated therewith which is secured by the releasable securement means. The releasable securement means optionally comprises a biasing member associated with an internal region of the associated rotatable segment. In one preferred embodiment, the biasing member biases against a portion of the axle and an associated sleeve portion of the axle for imparting a securing force thereon. The axle or the biasing member includes one or more cooperating portions for enabling one or more predetermined pivotal positions of the associated rotatable member. In such a preferred embodiment, the cooperating portions include one or more flat spots, notches, or embossments associated with at least one of the axle and biasing member. Of course, other conventional mechanical structures which facilitate releasable stoppable orientations are likewise contemplated for use.

DETAILED DESCRIPTION OF THE INVENTION

Figure 1:
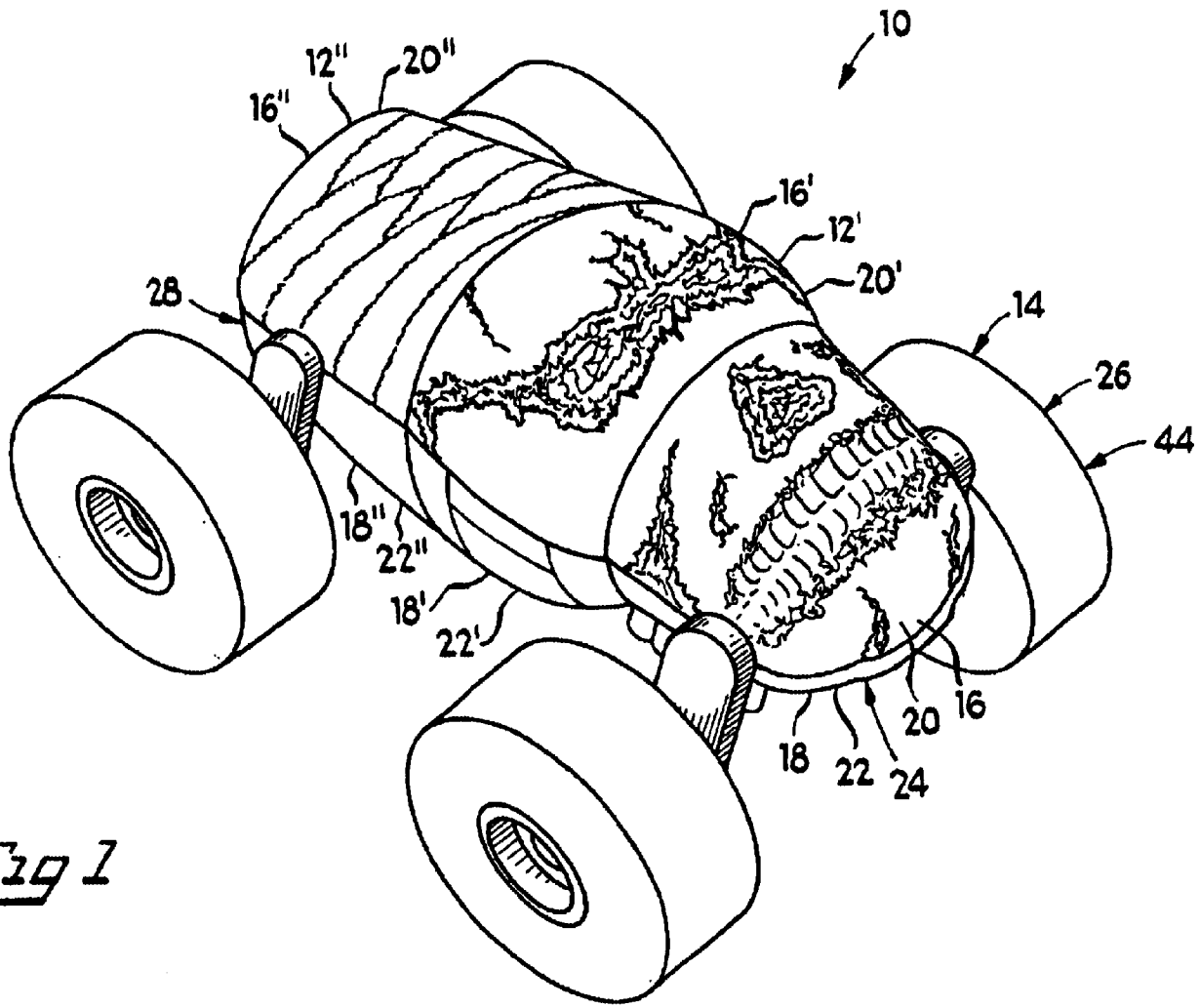
FIG. 1 of the drawings is a top view of a preferred embodiment of the present invention showing a toy vehicle having three rotatable segments.

While this invention is susceptible of embodiment in many forms, there is shown in the drawings and will be described in detail, several specific embodiments with the understanding that the present disclosure is to be considered as an exemplification of the principles of the invention and is not intended to limit the invention to the embodiments illustrated.

A multi-configurable toy vehicle 10 is shown in FIG. 1 as comprising at least two rotatable segments 12 and movement means 14. For purposes of clarity, specific ones of the elements of the toy vehicle will be identified with primes "'" when discussing operational interrelationships. FIG. 1 illustrates a toy vehicle having three rotatable segments 12, 12', 12". Each rotatable segment 12, 12', 12" has a first side 16, 16', 16" and a second side 18, 18', 18", respectively. Each first side has an associated first design 20, 20', 20" and each second side has an associated second design 22, 22', 22". Preferably, rotatable segments are disposed along a common axis positioned parallel to a bottom surface 24 of the toy vehicle. Each rotatable segment is independently rotatable with respect to the other of the rotatable segments such that the rotatable segments are configurable into a plurality of different combinations having either a first side orientation 26 or a second side orientation 27. By selectively rotating first design 20 or second design 22 of one rotatable segment 12 adjacent first design 20' or second design 22' of an adjacently positioned rotatable segment 12', toy vehicle 10 is manipulated into different combinations, wherein each combination may have, for example, a predetermined figure design 28. The figure design may optionally comprise a truck, tank, fictional character, non-fictional character, or any other design.

Figure 2:
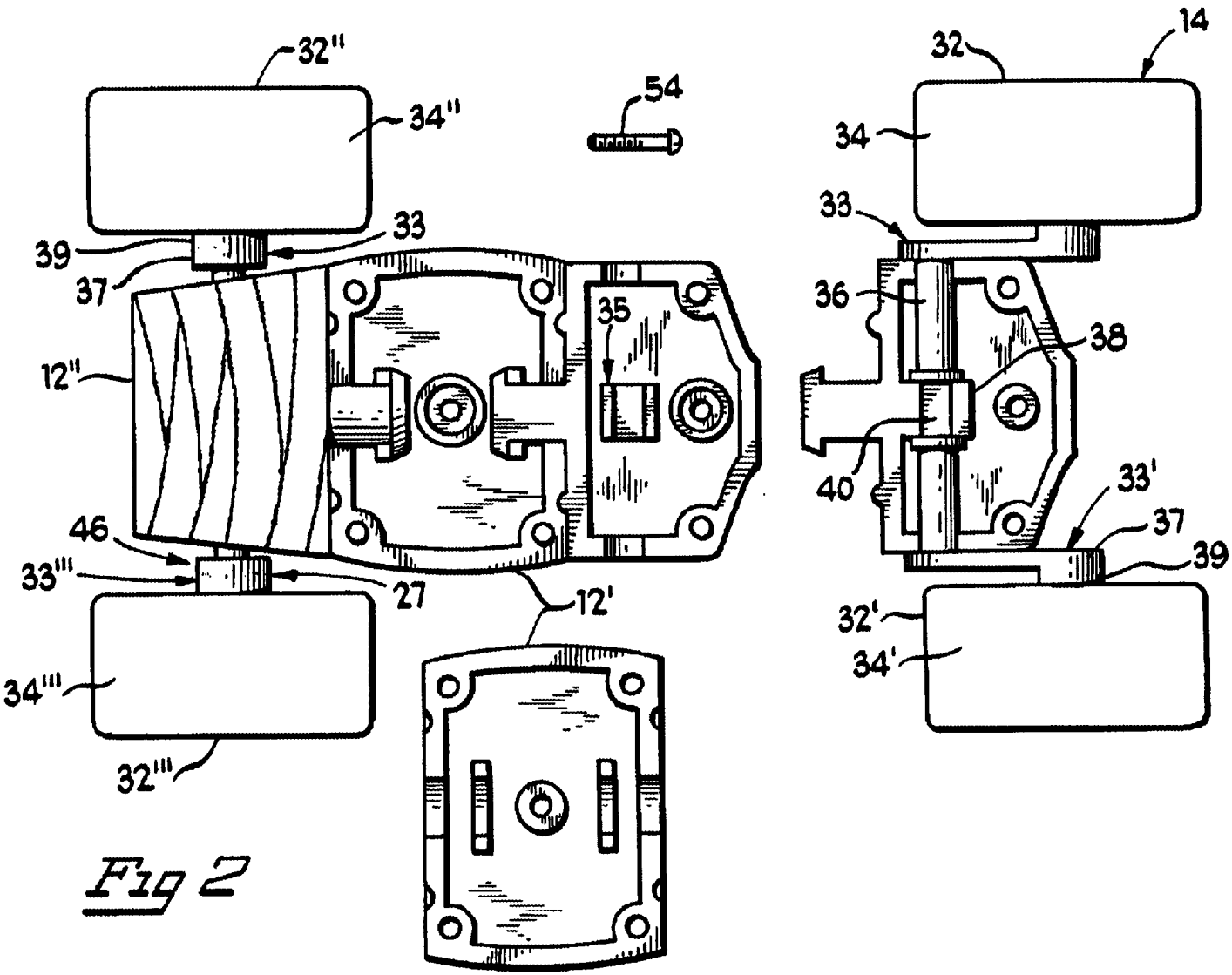
FIG. 2 is a partial, cut-away, and exploded view of the present invention.

Movement means 14, as shown in FIG. 2, enables operational movement of toy vehicle 10. In a preferred embodiment, movement means 14 includes at least one rotatable member 32, pivotal manipulation means 33, and releasable securement means 35. Rotatable members, such as rotatable members 32, 32', 32", 32'" may comprise wheels, such as wheels 34, 34', 34", 34'", treads, or any other suitable structure for enabling movement of toy vehicle 10. In one preferred embodiment, at least one rotatable member 32 is associated with one rotatable segment 12 and at least two rotatable members 32", 32'" are associated with another rotatable segment 12". By having at least one rotatable member on one rotatable segment and at least two rotatable members on another rotatable segment, toy vehicle 10 is balanced when resting on a surface. Rotatable members 32, 32', 32", 32'" may comprise axle 36 having an associated sleeve portion 38 to aid in securing the rotatable members to an associated rotatable segment. Axle 36 may include one or more cooperating portions 40, which are discussed in more detail below, for enabling one or more predetermined pivotal positions of an associated rotatable member.

Figure 3:
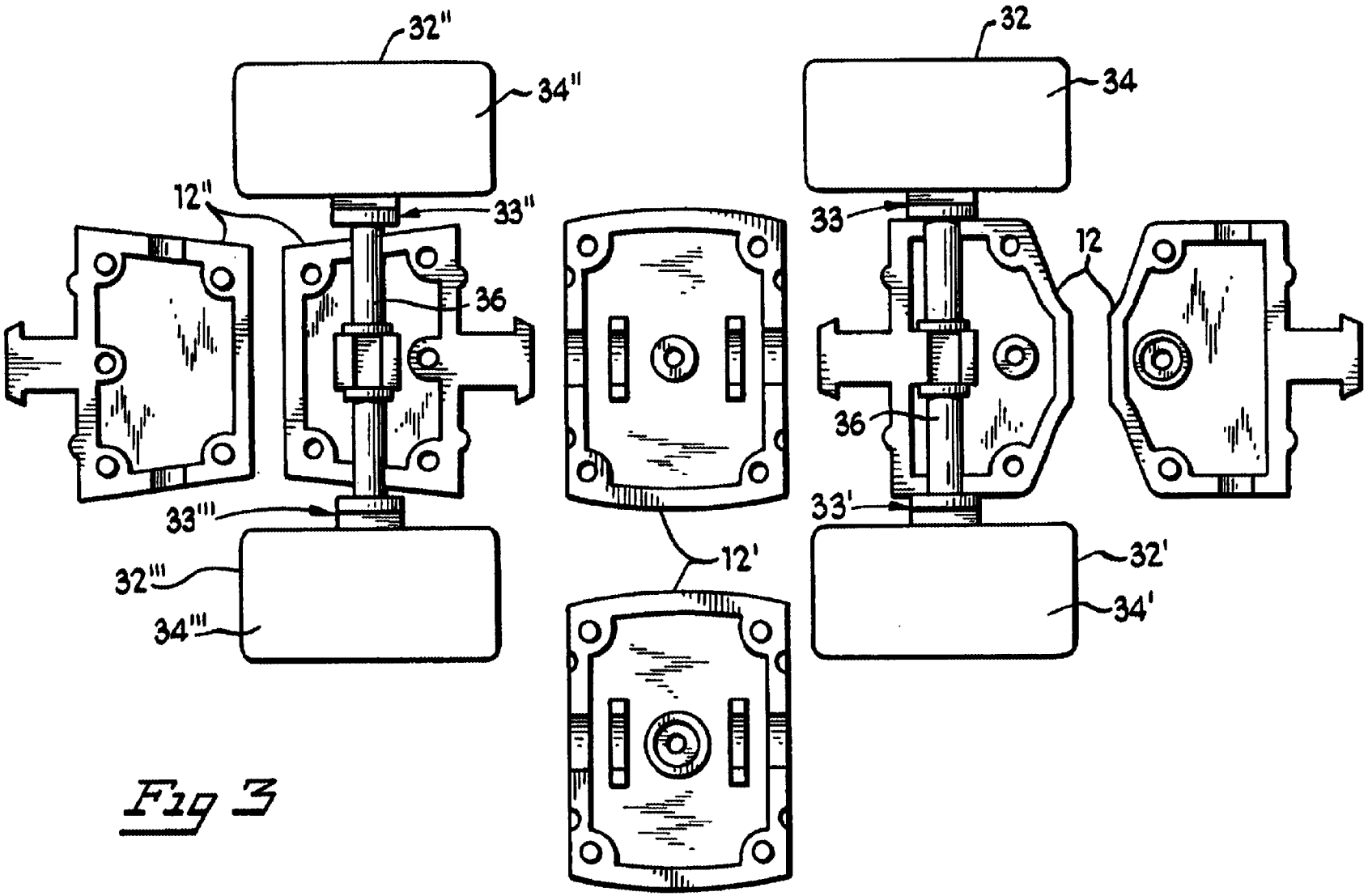
FIG. 3 is a partial, cut-away view of the present invention.

Pivotal manipulation means 33, as shown in FIG. 3, enables rotatable members to pivot to a predetermined position. In a preferred embodiment, pivotal manipulation means, such as pivotal manipulation means 33, 33', 33", 33'" are associated with rotatable members 32, 32', 32", 32'" respectively (such as wheels 34, 34', 34", 34'") at one end and are associated with axle 36 at an opposite end. First extension member 37 of each pivotal manipulation means extends perpendicularly from each end of associated axle 36. Second extension member 39 extends perpendicularly from an associated first extension member 37. The second extension members are adapted to engage associated wheels.

Pivotal manipulation means 33 pivots rotatable members from a first location 44 as shown in FIG. 1 to a second location 46 as shown in FIG. 2. At least a portion of the rotatable members, such as wheels 34, 34', 34", 34'", extend below a bottom surface of an associated rotatable segment (12, 12") in first location 44 and at least a portion of the rotatable members extend above a top surface of an associated rotatable segment in a second location 46. When rotatable members are in either the first location or second location, toy vehicle is in the first side orientation 26 or second side orientation 27 respectively, and, easily moves on a surface.

Figure 4:
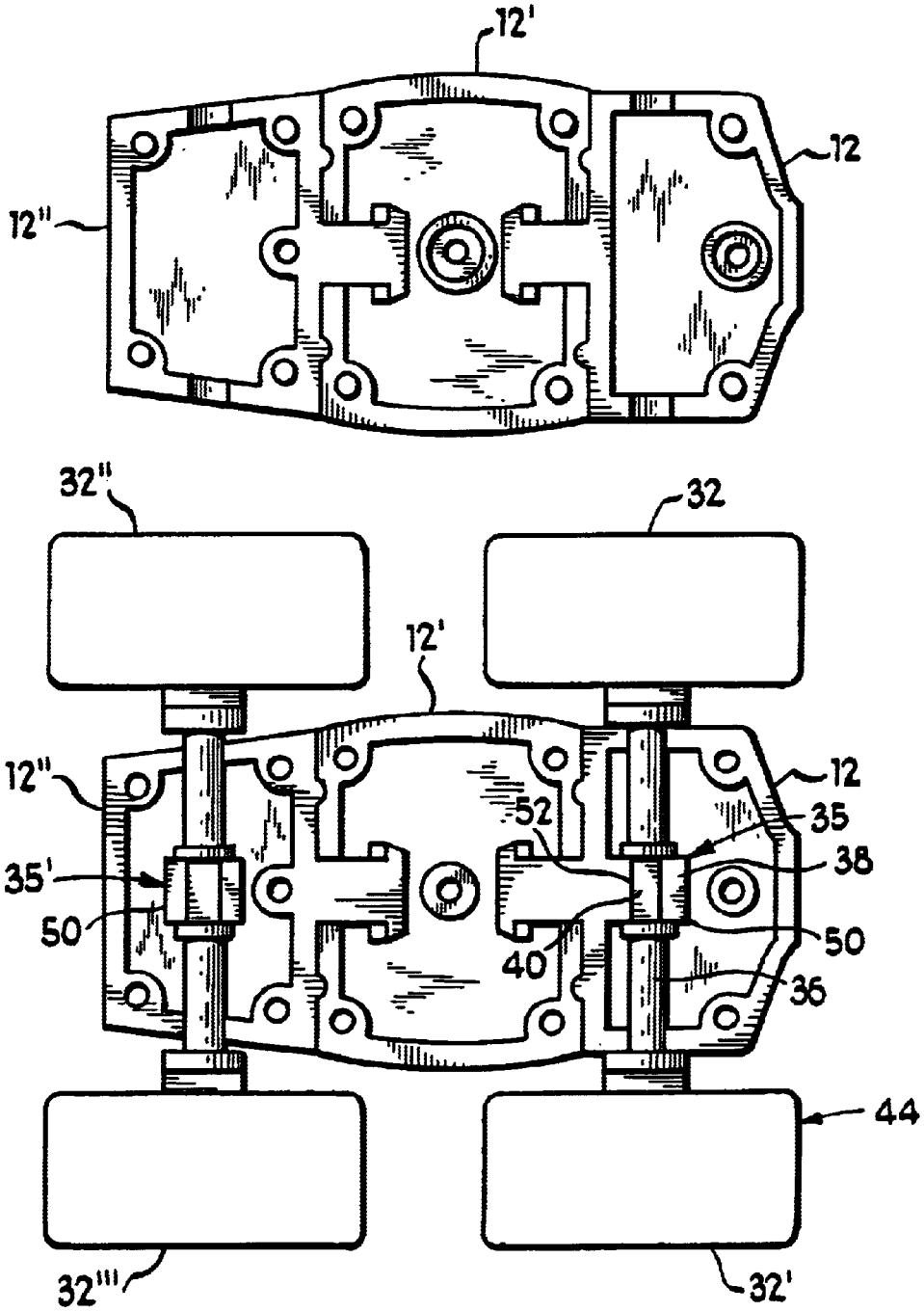
FIG. 4 is a cut-away and exploded view of the present invention showing the rotatable segments separated from one another.

Releasable securement means 35, 35' as shown in FIG. 4, enables rotatable members 32, 32', 32", 32'" to pivot with respect to an associated rotatable segment 12, 12', 12", but also releasably secures each rotatable member in a selected pivotal position such as first location 44 or second location 46. Releasable securement means 35, 35' preferably comprises a biasing member 50 associated with an internal region 52 of an associated rotatable segment. As described previously, axle 36 of an associated rotatable member may include an associated sleeve portion 38. The biasing member 50 biases against a portion of axle 36 or associated sleeve portion 38 to impart a securing force thereon. Preferably, the biasing member includes one or more cooperating portions 40 for enabling one or more predetermined pivotal positions of an associated rotatable member. Cooperating portions 40 may include one or more flat spots 52, notches, embossments or the like, associated with either or both of biasing member 50 and axle 36.

In operation, toy vehicle 10 preferably has three rotatable segments 12, 12', 12" as shown in FIG. 1. The rotatable segments are independently rotatable with respect to each other. When toy vehicle 10 has three rotatable segments, the user can selectively twist the rotatable segments into eight different combinations. In one preferred embodiment, each combination has an associated figure design 28 when the user rotates first design 20 or second design 22 of one rotatable segment 12 adjacent to first design 20' or second design 22' of an adjacently positioned rotatable segment 12'. As discussed previously, each first side 16, 16', 16" has an associated first design 20, 20', 20" and each second side 18, 18', 18" has an associated second design 22, 22', 22". Optionally, one first design and one second design are secured to one associated rotatable segment via a screw 54 parallel to a front side or a back side of toy vehicle. It is significant to note that while three rotatable segments 12, 12', 12" are used in this embodiment, it is contemplated that two rotatable segments may be used with the present invention, or alternatively, any number of rotatable segments greater than three can be selectively utilized which will result in a corresponding greater number of different combinations, each combination ultimately revealing a predetermined design.

In another embodiment, the number of rotatable segments 12 is at least three and at least one of the at least three rotatable segments has more than two sides, and preferably four sides. For example, the outer rotatable segments may have rotatable members associated therewith while the middle segment(s) have greater than two sides, and preferably four sides, and no rotatable members associated therewith. Each side of the middle segments(s) may have a different design. When the segments are rotated as discussed previously, the embodiment enables even a greater number of different combinations.

It is contemplated that the rotatable segments 12 need not rotate. Alternatively, toy vehicle 10 may include at least one segment, wherein the pivotal manipulation means pivots from first location 44 as shown in FIG. 1 to second location 46 as shown in FIG. 2 to provide for different configurations of the toy vehicle. At least one rotatable member 32 is associated with a first portion of the at least one segment, and, at least two rotatable members 32', 32" are associated with a second portion of the at least one segment.

Figure 5:
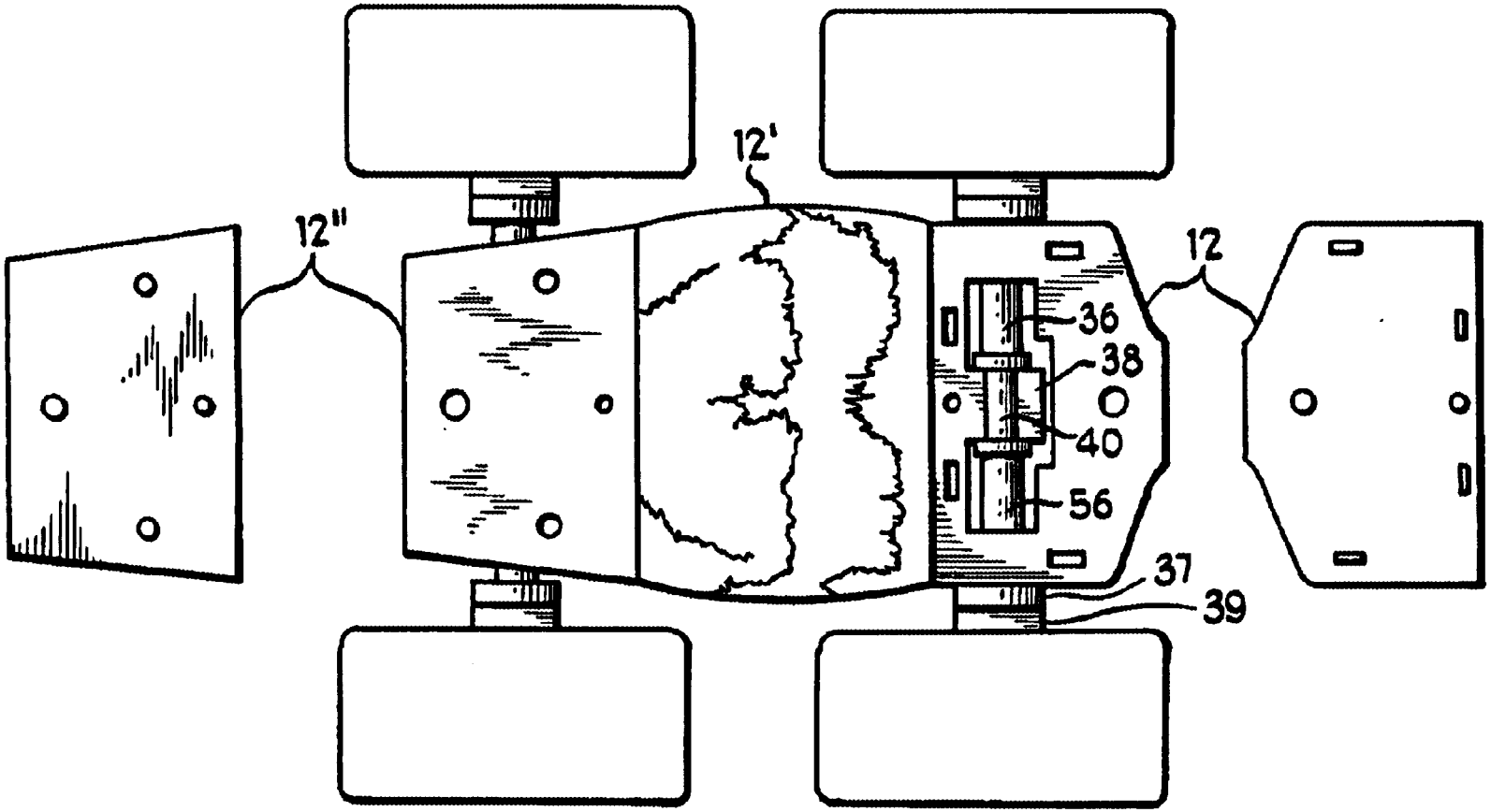
FIG. 5 is a partial, cut-away view of the present invention.

A preferred embodiment showing movement means 14 pivotally connected to an associated rotatable segment 12 is shown in FIGS. 4–5. Preferably, rotatable members 32, 32', 32", 32'" of movement means 14 are wheels 34, 34', 34", 34'" and at least one wheel 34 is disposed on a front rotatable segment 12 and at least two wheels 34", 34'" are disposed on a back rotatable segment 12" to facilitate movement of toy vehicle 10 on a surface. Movement means 14 preferably includes axle 36 to aid in securing each rotatable member to an associated rotatable segment. Preferably, axle 36 has shaft 56 which extends in a direction from an inner portion of one side of a rotatable segment to an inner portion of an opposite side of the same rotatable segment. Shaft 56 preferably has associated sleeve portion 38 disposed on an outer surface thereof. First extension member 37 of pivotal manipulation means 33 extends perpendicularly from each end of shaft 56. Second extension member 39 extends perpendicularly from each of the first extension members. Second extension members are adapted to engage an associated rotatable member, such as wheels 34, 34', 34", 34'". Biasing member 50 biases against a portion of axle 36 or associated sleeve portion 38 to impart a securing force thereon to secure movement means to an associated rotatable segment.

A preferred embodiment of biasing member 50 is shown in FIG. 4. The biasing member may optionally comprise a clip, a spring or any other suitable device having biasing properties. Preferably, each rotatable segment 12, 12" including an associated rotatable member 32, 32', 32", 32'" wherein biasing member is disposed within an internal region 52 thereof. Biasing member 50 extends parallel to a front side or back side of each rotatable segment. Optionally, the biasing member and internal region are molded from a single piece plastic or any other suitable material. Either or both of biasing member 50 and axle 36 preferably include one or more cooperating portions 40 to enable one or more predetermined pivotal positions of an associated rotatable member. In one embodiment, cooperating portions 40 include one or more flat spots 52 on associated sleeve portion 38 of axle 36 which are engaged by the biasing member. Cooperating portions 40 enable rotatable members to pivot to a predetermined pivotal position, and to stop at a selected position, such as first location 44 or second location 46.

In another embodiment, cooperating portions further include a plurality of embossments or notches disposed either on a top surface of the axle or associated sleeve portion and the biasing member may include a plurality of apertures adapted to selectively mate with the embossments. When at least one rotatable member is pivoted in a clockwise or counterclockwise direction with respect to an associated rotatable segment, selected embossments engage the apertures and the user may selectively stop rotatable members in any one of a number of predetermined pivotal positions such as the first location or the second location. In yet another embodiment, cooperating portions include a plurality of embossments or notches disposed on the biasing member and a plurality of apertures disposed on a top surface of the axle or associated sleeve portion adapted to selectively mate with embossments.

Figure 6:
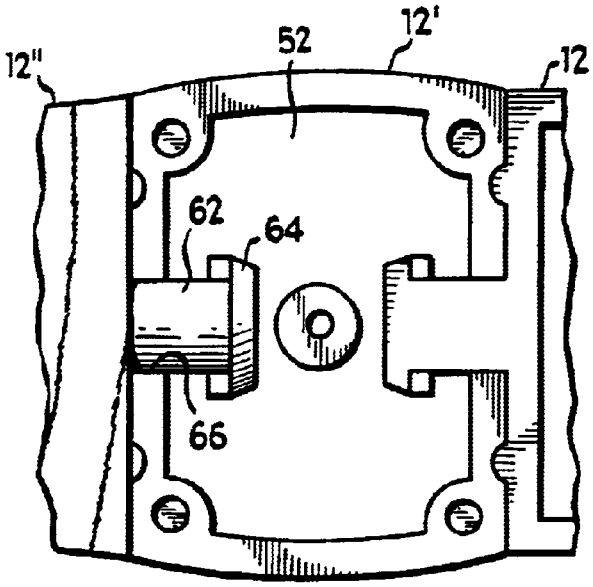
FIG. 6 is a partial, cut-away view of the present invention showing two rotatable segments secured in the interior region of an adjacent rotatable segment.
Figure 7:
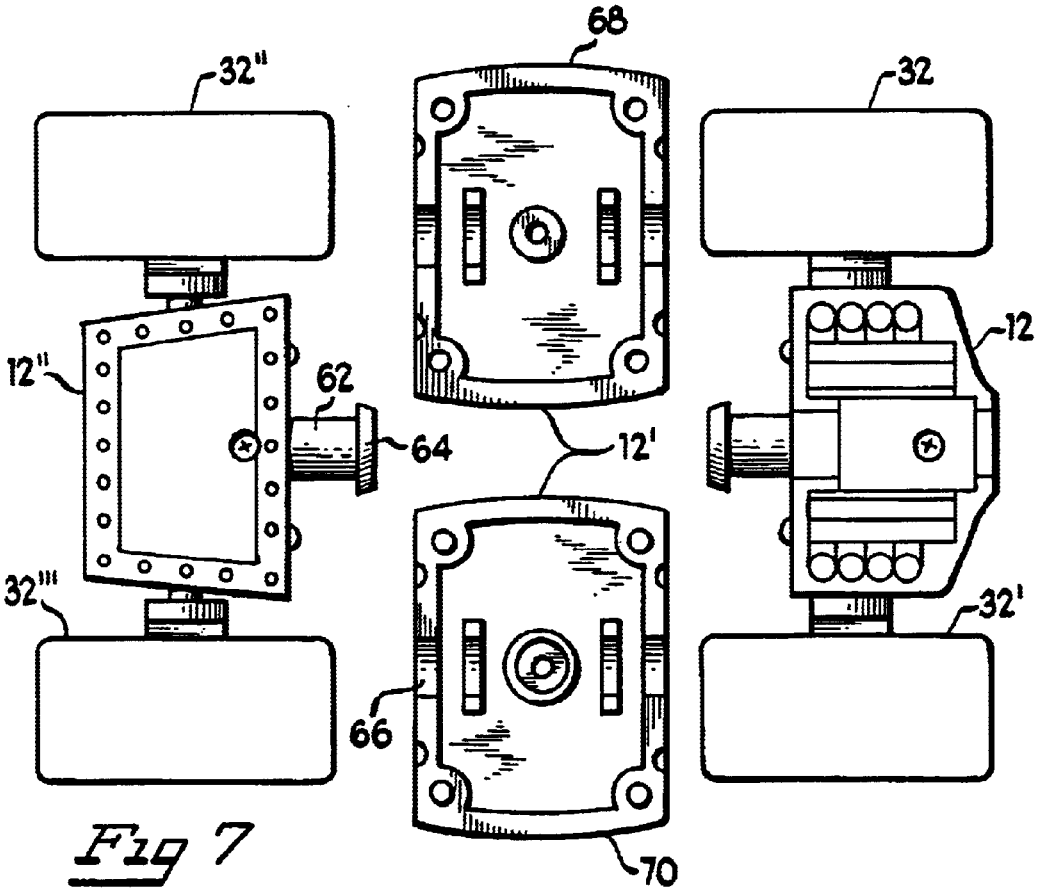
FIG. 7 is a partial, cut-away, and exploded view of the present invention.

A preferred means for securing one rotatable segment 12 to an adjacent rotatable segment 12' is shown in FIGS. 6–7. Each rotatable segment may have a male member 62 extending from an outer portion thereof, and each male member includes flange 64. Male member 62 of one rotatable segment is preferably disposed within groove 66 of internal region 52 of adjacent rotatable segment 12'. Groove 66 enables rotation of one rotatable segment 12 with respect to another rotatable segment 12'. Additionally, each rotatable segment may comprise two halves, a first body 68 and a second body 70, wherein first body 68 and second body 70 are securable to one another by any suitable means such as via screw 54, adhesive, molding, or mating male and female members. Alternatively, rotatable segments are optionally molded as a single integral piece from plastic or any other suitable material.

What is claimed is:

1. A multi-configurable toy vehicle comprising:

at least two rotatable segments, wherein each of the rotatable segments includes a first side having a first design, and, a second side having a second design, and, wherein each of the rotatable segments is independently rotatable with respect to each other from a first side orientation to a second side orientation; and means for enabling movement of the multi-configurable toy vehicle on a surface, wherein the movement means is associated with at least two of the at least two rotatable segments, and, wherein the movement means facilitates operation of the multi-configurable toy vehicle when any of the rotatable segments are in at least one of the first side and second side orientations.

2. The toy vehicle according to claim 1, wherein the first side and the second side of the at least two rotatable segments are rotatable into a plurality of different combinations associated with each respective first side orientation and second side orientation.

3. The toy vehicle according to claim 2, wherein at least one of the first design and the second design of one rotatable segment is selectively rotated adjacent at least one of the first design and the second design of an adjacently positioned rotatable segment so as to form a predetermined figure design.

4. The toy vehicle according to claim 2, wherein the number of different combinations is eight.

5. The toy vehicle according to claim 1, wherein the at least two rotatable segments are disposed along a common axis.

6. The toy vehicle according to claim 5, wherein the common axis is parallel to a bottom surface of the toy vehicle.

7. The toy vehicle according to claim 1, wherein the movement means comprises at least one rotatable member associated with a first one of the at least two rotatable segments, and, at least two rotatable members associated with a second one of the at least two rotatable segments.

8. The toy vehicle according to claim 7, wherein the rotatable members comprise at least one of wheels, treads, and other conventional structures suitable for enabling movement of the toy vehicle.

9. The toy vehicle according to claim 7, wherein the movement means includes means for pivotally manipulating at least one of the rotatable members from a first location, wherein at least a portion of the at least one rotatable member extends below a bottom surface of the associated rotatable segment, to a second location, wherein at least a portion of the at least one rotatable member extends above a top surface of the associated rotatable segment.

10. The toy vehicle according to claim 9, further including means for releasably securing at least one of the rotatable members in a selected location.

11. The toy vehicle according to claim 10, wherein and at least one rotatable member includes an axle, and, wherein the releasable securement means comprises a biasing member associated with an internal region of an associated rotatable segment;

the biasing member biasing against a portion of at least one of the axle and an associated sleeve portion of the axle for imparting a securing force thereon.

12. The toy vehicle according to claim 11, wherein at least one of the axle and the biasing member includes one or more cooperating portions for enabling one or more predetermined pivotal positions of the associated rotatable member.

13. The toy vehicle according to claim 12, wherein the cooperating portions include one or more flat spots, notches, and embossments associated with at least one of the axle and biasing member.

14. The toy vehicle according to claim 1, wherein the at least two rotatable segments comprise at least three rotatable segments independently rotatable with respect to each other.

15. The toy vehicle according to claim 14, wherein at least one of the first design and the second design of one rotatable segment is selectively rotated adjacent at least one of the first design and the second design of an adjacently positioned rotatable segment so as to form a predetermined figure design.

16. The toy vehicle according to claim 1, wherein the number of rotatable segments is at least three, and, wherein at least one of the rotatable segments has more than two sides.

17. A multi-configurable toy vehicle comprising:

at least one segment;

means for enabling movement of the at least one segment on a surface;

wherein, the movement means includes at least one rotatable member associated with a first portion of the at least one segment, and, at least two rotatable members associated with a second portion of the at least one segment;

and wherein, the movement means further includes means for pivotally manipulating at least one of the rotatable members from a first location, wherein at least a portion of the at least one rotatable member extends below a bottom surface of the at least one segment to a second location, wherein at least a portion of the at least one rotatable member extends above a top surface of the at least one segment.

18. The toy vehicle according to claim 17, wherein the rotatable members comprise at least one of wheels, treads, and other conventional structures suitable for enabling movement of the toy vehicle.

19. The toy vehicle according to claim 17, further including means for releasably securing at least one of the rotatable members in a selected location.

20. The toy vehicle according to claim 19, wherein and at least one rotatable member includes an axle, and, wherein the releasable securement means comprises a biasing member associated with an internal region of the at least one segment;

the biasing member biasing against a portion of at least one of the axle and an associated sleeve portion of the axle for imparting a securing force thereon.

21. The toy vehicle according to claim 20, wherein at least one of the axle and the biasing member includes one or more cooperating portions for enabling one or more predetermined pivotal positions of the associated rotatable member.

22. The toy vehicle according to claim 21, wherein the cooperating portions include one or more flat spots, notches, and embossments associated with at least one of the axle and biasing member.

* * * * *